US007137216B2

(12) United States Patent
Ali et al.

(10) Patent No.: US 7,137,216 B2
(45) **Date of Patent: *Nov. 21, 2006**

(54) IMPRINTABLE TAPE WITH TEAR LINES DEFINING IDENTIFICATION BRACELETS

(75) Inventors: Sherif M. Ali, Los Angeles, CA (US); Mark M. Kotik, Taylor, MI (US)

(73) Assignee: Precision Dynamics Corporation, San Fernando, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/993,209

(22) Filed: Nov. 18, 2004

(65) Prior Publication Data

US 2005/0262747 A1 Dec. 1, 2005

Related U.S. Application Data

(63) Continuation-in-part of application No. 10/858,581, filed on Jun. 1, 2004.

(51) Int. Cl.
*A44C 5/00* (2006.01)

(52) U.S. Cl. ..... 40/633; 40/665; 428/906; 283/900

(58) Field of Classification Search ..... 40/633, 40/665, 674; 428/906; 283/75, 900; 24/17 AP, 24/30.5 P See application file for complete search history.

(56) References Cited

U.S. PATENT DOCUMENTS

| | | | | |
|---|---|---|---|---|
| 2,399,545 | A * | 4/1946 | Davis | 604/389 |
| 3,825,463 | A * | 7/1974 | Amann | 428/41.1 |
| 4,914,843 | A | 4/1990 | DeWoskin | |
| 5,581,924 | A | 12/1996 | Peterson | |
| 5,799,426 | A | 9/1998 | Peterson | |
| 6,058,637 | A | 5/2000 | Duncan | |
| 6,335,686 | B1 * | 1/2002 | Goff et al. | 340/572.4 |
| 6,598,800 | B1 * | 7/2003 | Schmit et al. | 235/462.44 |

* cited by examiner

*Primary Examiner*—Gary C. Hoge
(74) *Attorney, Agent, or Firm*—Kelly Lowry & Kelley, LLP

(57) ABSTRACT

A flexible, substantially non-stretchable, imprintable tape which includes lines of weakness constituting tear lines defining in outline a longitudinal series of identification bracelets. Each bracelet has a generally rectangular imprintable portion, an elongated strap portion at one end of the imprintable portion, and a stubby strap portion at an opposite end of the imprintable portion. The imprintable portion has a width equal to the width of the tape and the elongated and stubby portions each have a width less than that of the tape. The elongated strap portion has a longitudinal edge aligned with one of the side edges of the tape and an opposite longitudinal edge defined by one of the lines of weakness. The stubby strap portion has a longitudinal edge aligned with an opposite side edge of the tape relative to the elongated strap portion and an opposite longitudinal edge defined by another one of the lines of weakness.

37 Claims, 3 Drawing Sheets

IMPRINTABLE TAPE WITH TEAR LINES DEFINING IDENTIFICATION BRACELETS

RELATED APPLICATION

This application is a continuation-in-part of U.S. application Ser. No. 10/858,581, filed Jun. 1, 2004.

BACKGROUND OF THE INVENTION

The invention relates generally to bracelets. More particularly, the invention relates to a tape of bracelets with tear lines defining the bracelets.

There is a great need for identification bracelets that can be used in various environments, such as sports events, hospitals, music concerts and the like. Over the years, many types of identification bracelets have been developed for these purposes. However, such bracelets have comfort issues relating to their use. For example, U.S. Pat. No. 4,914,843 discloses a roll of bracelets arranged end-to-end along a tape of uniform width. However, the roll is shaped such that mating one end of the bracelet to the other can result in discomfort to the wearer. In another example, U.S. Pat. No. 5,799,426 discloses a bracelet of uniform width along the length of the entire bracelet. However, while the width is useful in the central area to accommodate the placement of information, the width of the bracelet is likely to cause discomfort to the wearer. In another example, U.S. Pat. No. 6,058,637 discloses a roll of bracelets arranged end-to-end along a tape of uniform width. However, the shape of the bracelets of the roll is likely to cause discomfort to the wearer.

Accordingly, there is a need for a bracelet that provides the wearer with a comfortable fit. There is a further need for a roll of bracelets that are shaped to provide a comfortable fit. There is an additional need to provide a roll of bracelets shaped to minimize the amount of the roll that is wasted. The present invention satisfies these needs and provides other related advantages.

SUMMARY OF THE INVENTION

The present invention provides a bracelet that is comfortable for the wearer. The present invention further provides a roll of bracelets that are shaped to provide a comfortable fit. The present invention also provides a roll of bracelets shaped to minimize the amount of the roll that is wasted.

An embodiment of the present invention, in the form of a flexible, substantially non-stretchable, imprintable tape, includes parallel side edges. The tape has lines of weakness constituting tear lines defining in outline a longitudinal series of identification bracelets.

Each bracelet has a generally rectangular imprintable portion, a first elongated strap portion at one end of the imprintable portion, and a second elongated strap portion at an opposite end of the imprintable portion. The imprintable portion has a width equal to the width of the tape and the first and second portions each have a width substantially less than that of the tape. The first strap portion has a longitudinal edge defined by one of the side edges of the tape and an opposite longitudinal edge defined by one of the lines of weakness. The second strap portion has a longitudinal edge defined by an opposite side edge of the tape relative to the first strap portion and an opposite longitudinal edge defined by another one of the lines of weakness.

The bracelets are aligned, generally end-to-end, such that a portion of the elongated strap portion of at least one bracelet is generally adjacent and parallel to the stubby strap portion of an adjacent bracelet. The tape is rolled into a coil.

The imprintable and first strap portions share a common edge of the tape and the imprintable and second strap portions share an opposite common edge of the tape. The first and second strap portions of adjacent bracelets are separated by the lines of weakness. The lines of weakness extend generally along the longitudinal midline of the tape and extend to the edges of the tape at the extremities of the lines of weakness. The lines of weakness can be in the form of die-cuts extending partially through the tape.

The elongated strap portion of each bracelet includes means for operatively connecting the elongated and stubby strap portions. The connecting means includes at least one aperture.

The elongated strap portion further includes a plurality of longitudinally extending apertures. The stubby strap portion also includes a plurality of longitudinally extending apertures.

In one embodiment, the tape includes a machine readable radio frequency identifcation chip associated with each bracelet. An antenna is operatively connected to the chip.

In another embodiment, the tape includes a card associated with each bracelet with a machine readable radio frequency identification chip and antenna embedded in the card.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
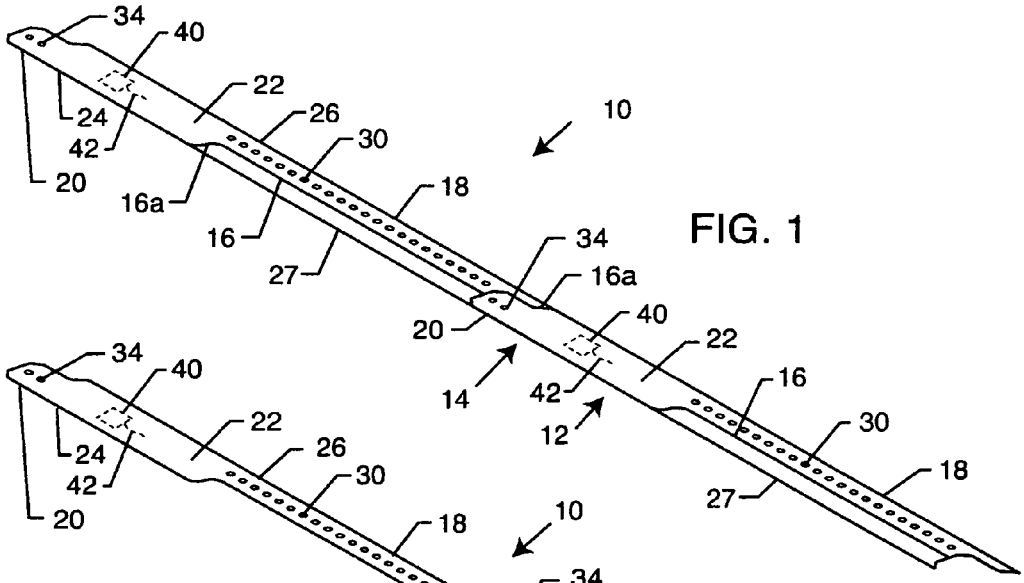
FIG. 1 is a view of two identification bracelets connected end to end, embodying the present invention.
Figure 2:
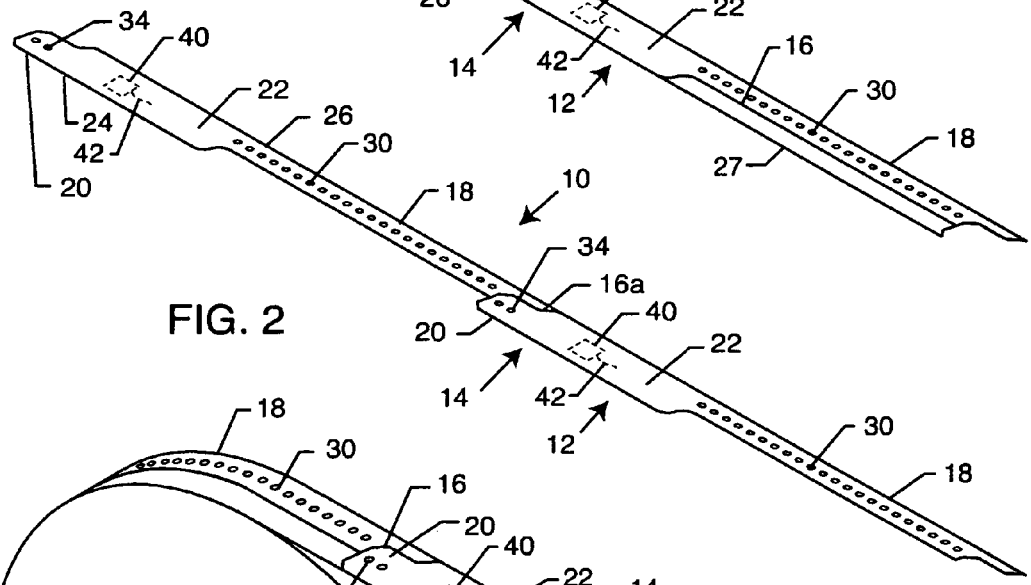
FIG. 2 is a view similar to FIG. 1, with waste portions removed from the assembly.
Figure 3:
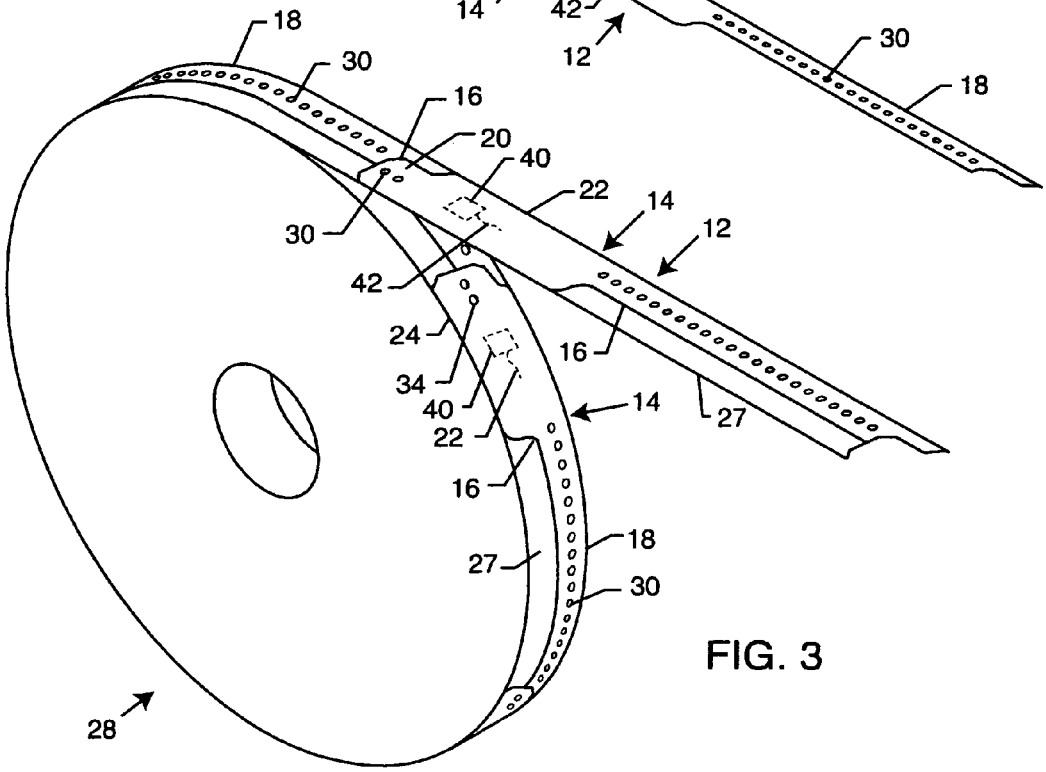
FIG. 3 is a view of a tape roll including bracelets embodying the present invention.
Figure 4:
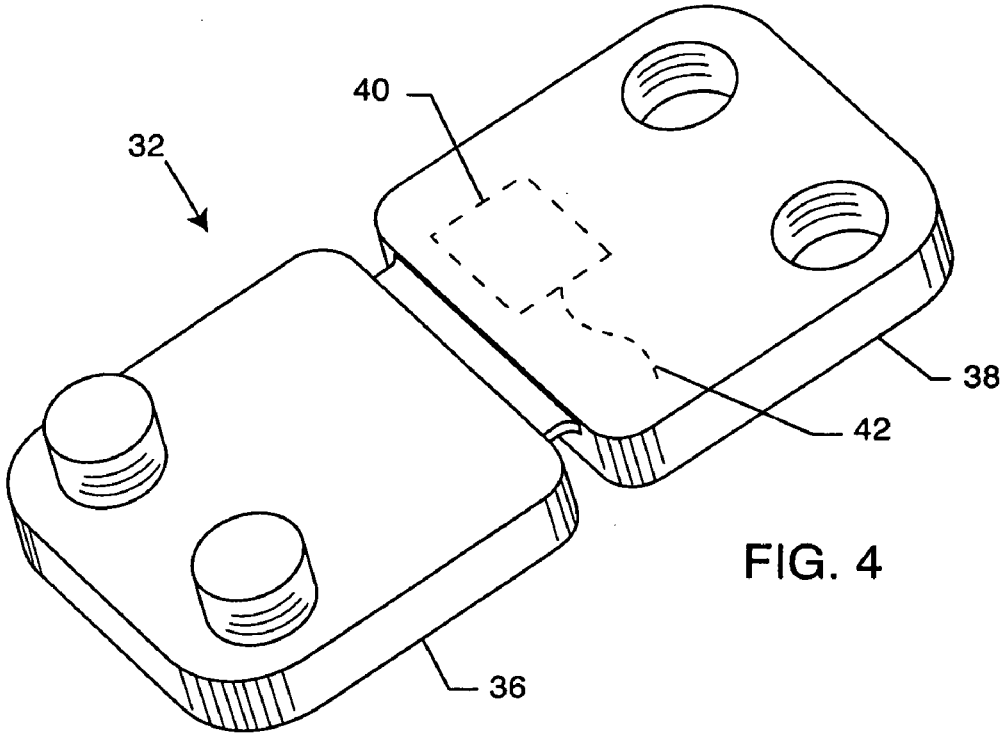
FIG. 4 is a view of a fastener for use with an identification bracelet embodying the present invention.

As shown in the drawings for purposes of illustration, the present invention resides in an imprintable (via hand or machine) tape with tear lines defining identification bracelets. As illustrated in FIGS. 1–3, a tape 10 includes a flexible, elongated body 12 including a plurality of wristbands or bracelets 14 defined by lines of weakness or tear lines 16 in the body 12. The tape 10 is of uniform width long its length and made from a machine-imprintable material that is relatively thin, tough, flexible and stretch-resistant so as to provide an outer surface capable of having indicia printed (via hand-held writing implements, e.g., pens, pencils, markers or the like, and conventional ink printers or the like) or otherwise marked thereon. The tape 10 is preferably manufactured from a plurality of suitably strong, lightweight, flexible laminates such as plastic, polyethylene, polypropylene, or the like, through any of a variety of appropriate laminating processes. Other materials include, but are not limited to, a tri-laminate of paper, polyester and textured polyethylene. These materials may be treated such that the surface of the tape 10 is thermally sensitive, allowing indicia to be created thereon by heat.

The bracelets 14 form the entire body 12 of the tape 10. Each bracelet 14 including an elongated strap portion 18, a stubby strap or tab portion 20, and intermediate or imprintable portion 22 therebetween. Each bracelet 14 is generally S-shaped. The intermediate portion 22 equal in width to the body 12. The strap 18 portion has a width generally half that of the intermediate portion 22 or the width of the body 12. The tab 20 portion has a width generally greater than half that of the intermediate portion 22 or the width of the body 12 but less than the full width of the intermediate portion 22 or the width of the body 12. All of the bracelets 14 have the same orientation with respect to the body 12.

The S-shape of the bracelet 14 provides a comfortable fit for the wearer. The bracelets 14 of the body 12 are aligned, generally end-to-end along the length of the tape 10. The strap portion 18 of at least one bracelet 14 is generally adjacent and parallel to the tab portion 20 of an adjacent bracelet 14. The intermediate 22 and tab 20 portions share a common edge 24 of the body and the intermediate 22 and strap 18 portions share an opposite common edge 26 of the body 12. The shape and positioning of the bracelets 14 along the length of the tape 10 form waste portions 27 bordered by the common edge 24, the intermediate portion 22, the tab portion 20 and the strap portion 18. The waste portions 27 are removed from the tape 10 either prior to or after the bracelet 14 to which the waste portion 27 is attached is removed from the tape 10. The S-shape of the bracelets 14 allows the amount of space taken up by the waste portions 27 to be minimized.

The bracelets 14 of the tape 10 are separable from one another along lines of weakness or tear lines 16. The tear lines 16 are perforations or die-cuts extending partially through the body 12. These tear lines 16, forming most of the border between adjacent bracelets 14 are primarily located between the tab 20 and strap 18 portions of adjacent bracelets 14. Another portion of the border between adjacent bracelets 14 are tear lines 16*a* located between the tab 20 and intermediate 22 portions and strap 18 and intermediate 22 portions of adjacent bracelets 14. In the alternative, the tear lines 16 can be scored or kiss-cut in order to provide a smooth edge. The tear lines 16 extend through nearly the full thickness of the tape 10.

The tape 10 can be rolled into a coil 28. This allows the tape 10 to be placed within a dispenser (not shown), fed through a computer printer (not shown), such as a direct thermal printer or a thermal transfer printer, etc.

The strap portion 18 includes a plurality of openings or apertures 30 extending longitudinally along a portion of the strap portion 18. The apertures 30 extend along a longitudinal midline of the strap portion 18 and are evenly spaced along the length of the strap portion 18. As illustrated in FIGS. 1–5, the tab portion 20 of each bracelet 14 includes a connector or fastener 32 to connect the tab 20 and strap 18 portions together to hold the bracelet 14 in a closed arrangement. There is at least one opening or aperture 34, preferably several apertures 34, located along the length of the tab portion 20. The apertures 34 extend along a longitudinal midline of the tab portion 20 and are unevenly spaced individually or spaced evenly in groups along the length of the tab portion 20. The fastener 32 supports and retains the bracelet 14 in a closed loop configuration encircling an object or an individual to be identified, and the fastener 32, adapted for subsequent assembly and re-use with a replacement bracelet 14, is removable from aperture 34 prior to disposal of the bracelet 14. The connector 32 includes locking elements in the form of at least one male member 36 and at least one female receptacle 38 fabricated from a suitable plastic, such as high-density polyethylene, and operating as snap fasteners but incorporating self-locking means, not shown, to maintain the bracelet 14 in operative relationship with an object or person identified by the bracelet 14. Alternatively, the connector 32 may be non-removable in order to render the bracelet 14 available only for a single-use and require damage to and/or destruction of the bracelet 14 in order to remove it from the wearer.

Figure 5:
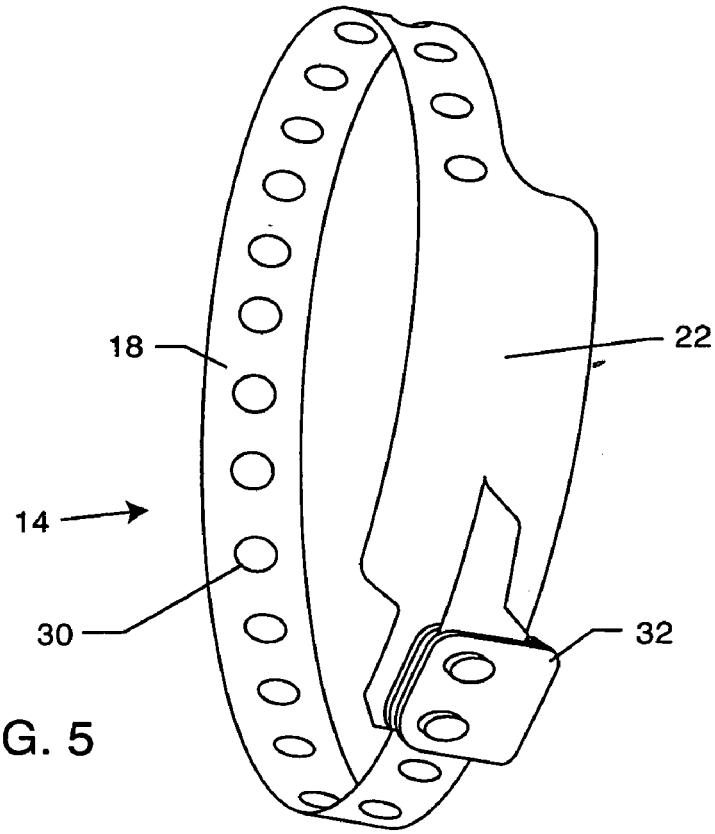
FIG. 5 is a view of an identification bracelet embodying the present invention in a closed configuration.

As illustrated in FIG. 5, the fastener 32 clamps the strap 18 and tab 20 portions together in selected positions of adjustment when the fastener 32 is closed. The degree to which the bracelet 14 is held closed depends on several factors including, for example, the size of a wearer's wrist and which apertures 30, 34 the fastener 32 engages.

Information is imprintable upon each bracelet 14, primarily upon the intermediate portion 22 of the bracelet 14. The length of the strap 18, tab 20 and intermediate 22 portions combined approximately form the total length of each bracelet 14 although the respective lengths of the individual portions 18, 20, 22 may vary. As seen in FIGS. 1–3 and 6–7, the elongated strap portion 18 comprises approximately half or more the length of the bracelet 14 while the intermediate portion forms about one third the length of the bracelet 14. The stubby tab portion 20 comprises the remaining length of the bracelet 14.

A non-contact machine readable radio frequency identification (RFID) chip 40 is located on or embedded within each bracelet 14. An antenna 42 is operatively connected to the chip 40. Alternatively, the chip 40 may be a self-contained module that includes an antenna. In another alternative, the antenna 42 is embedded in the fastener 32 and operatively connected to the chip 40. In yet another alternative, both the chip 40 and the antenna 42 are operatively connected to each other and embedded in the fastener 32.

Figure 6:
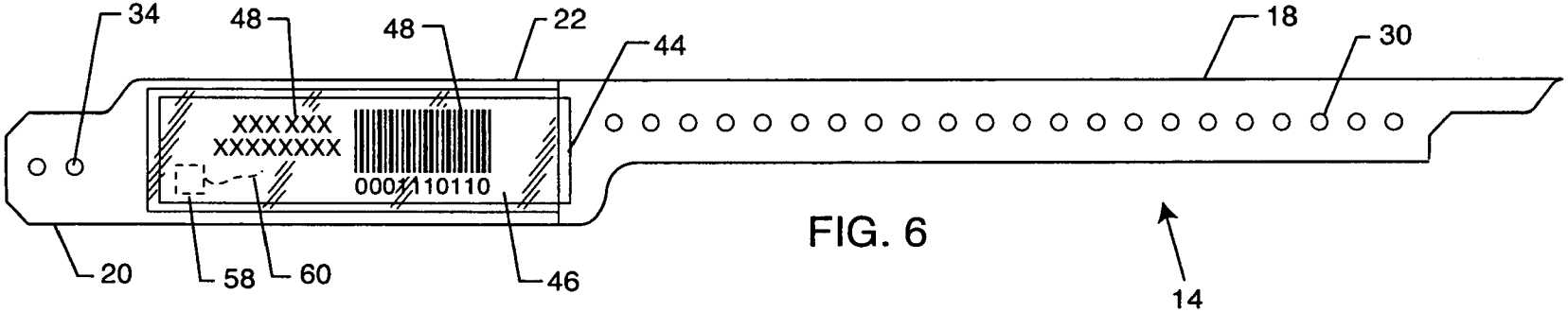
FIG. 6 illustrates an identification bracelet, embodying the present invention, having a card-receiving pocket.

FIG. 6 shows a card 44 inserted within a transparent pocket 46 of the bracelet 14. The card 44 may include visual identification indicia 48 such as lettering, markings and/or bar codes and an RFID chip 50 may also be embedded within the card 44. An antenna 52 is operatively connected to the chip 50.

Figure 7:
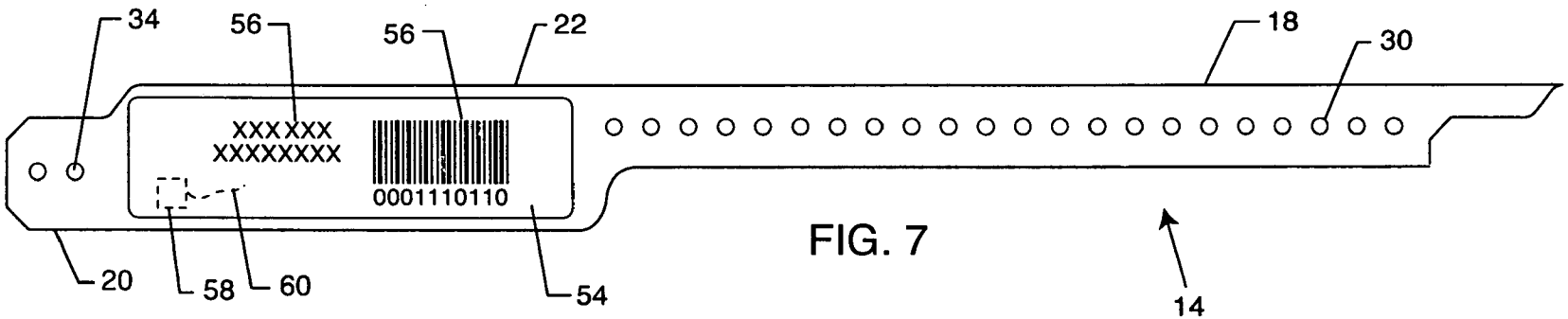
FIG. 7 is illustrates an identification bracelet embodying the present invention, having a label attached thereto.

As illustrated in FIG. 7, a label 54 is adhered along the exterior of the bracelet 14. The label 54 may include visual identification indicia 56 such as lettering, markings and/or bar codes and an RFID chip 58 may also be embedded within the label 54. An antenna 60 is operatively connected to the chip 58. In the alternative, a tag, card or the like may also be adhered to the bracelet 14.

In use, the tape 10 provides a bracelet 14 that is comfortable for the wearer. The S-shape of the bracelet 14 allows the bracelet 14 to be held on the wearer while minimizing the width of the bracelet 14 and area of the wearer's body that the bracelet 14 comes in contact with. The tape 10 also provides a coil roll 28 of bracelets 14. The S-shape of the bracelets 14 and the way that the strap and tab portions 18, 20 of adjacent bracelets 14 are arranged, allow the entire length of the tape 10 to be used.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A flexible, substantially non-stretchable, imprintable tape having parallel side edges and front and back non-adhesive surfaces; the tape having lines of weakness constituting tear lines defining in outline a longitudinal series of identification bracelets; each bracelet having a generally rectangular imprintable portion, an elongated strap portion at one end of the imprintable portion, and a stubby strap portion at an opposite end of the imprintable portion; the imprintable portion being of a width equal to the width of the tape and the elongated and stubby portions each having a width less than that of the tape; the elongated strap portion having a longitudinal edge defined by one of the side edges of the tape and having an opposite longitudinal edge defined by one of the lines of weakness and, the stubby strap portion having a longitudinal edge defined by an opposite side edge of the tape relative to the elongated strap portion and having an opposite longitudinal edge defined by another one of the lines of weakness.

2. The tape of claim 1, wherein the imprintable and elongated strap portions share a common edge of the tape.

3. The tape of claim 2, wherein the imprintable and stubby strap portions share an opposite common edge of the tape.

4. The tape of claim 1, wherein the bracelets are aligned such that a portion of the elongated strap portion of at least one bracelet is adjacent and parallel to the stubby strap portion of an adjacent bracelet.

5. The tape of claim 4, wherein the elongated and stubby strap portions of adjacent bracelets are separated by one of the lines of weakness.

6. The tape of claim 5, wherein the lines of weakness extend generally along a longitudinal midline of the tape and extend to the side edges of the tape at extremities of the lines of weakness.

7. The tape of claim 1, wherein the tape is rolled into a coil.

8. The tape of claim 1, wherein the elongated strap portion of each bracelet includes means for operatively connecting the elongated and stubby strap portions.

9. The tape of claim 8, wherein the connecting means includes at least one aperture.

10. The tape of claim 9, wherein the stubby strap portion of each bracelet includes a plurality of longitudinally extending apertures.

11. The tape of claim 10, wherein the elongated strap portion of each bracelet includes a plurality of longitudinally extending apertures.

12. The tape of claim 1, wherein the lines of weakness are die-cuts extending partially through the tape.

13. The tape of claim 1, including a machine readable radio frequency identification chip associated with each bracelet.

14. The tape of claim 13, including an antenna operatively connected to each chip.

15. The tape of claim 1, including a transparent pocket containing a card associated with each bracelet.

16. The tape of claim 15, including a machine readable radio frequency identification chip and antenna embedded in each card.

17. The tape of claim 1, wherein the elongated strap portion has a length substantially longer than the width of the tape.

18. A flexible, substantially non-stretchable, imprintable tape having parallel side edges; the tape having lines of weakness constituting tear lines defining in outline a longitudinal series of identification bracelets; each bracelet having a machine readable radio frequency identification chip, an antenna operatively connected to the chip, a generally rectangular imprintable portion, an elongated strap portion at one end of the imprintable portion, and a stubby strap portion at an opposite end of the imprintable portion; the imprintable portion being of a width equal to the width of the tape and the elongated and stubby portions each having a width less than that of the tape; the elongated strap portion having a longitudinal edge defined by one of the side edges of the tape and having an opposite longitudinal edge defined by one of the lines of weakness and, the stubby strap portion having a longitudinal edge defined by an opposite side edge of the tape relative to the elongated strap portion and having an opposite longitudinal edge defined by another one of the lines of weakness.

19. The tape of claim 18, wherein the bracelets are aligned such that a portion of the elongated strap portion of at least one bracelet is adjacent and parallel to the stubby strap portion of an adjacent bracelet.

20. The tape of claim 19, wherein the elongated and stubby strap portions of adjacent bracelets are separated by one of the lines of weakness.

21. The tape of claim 18, wherein the stubby strap portion of each bracelet includes a plurality of longitudinally extending apertures.

22. The tape of claim 18, wherein the elongated strap portion of each bracelet includes a plurality of longitudinally extending apertures.

23. The tape of claim 18, wherein each bracelet has a transparent pocket, the pocket including a card associated with each bracelet, wherein each machine readable radio frequency identification chip is embedded in one of the cards.

24. The tape of claim 18, wherein the elongated strap portion has a length substantially longer than the width of the tape.

25. A flexible, substantially non-stretchable, imprintable tape having parallel side edges rolled into a coil; the tape having lines of weakness extending partially through the tape, generally along a longitudinal midline of the tape and to the side edges of the tape at extremities of the lines of weakness, the lines of weakness constituting die-cut tear lines defining in outline a longitudinal series of identification bracelets oriented generally along the longitudinal midline of the tape; each bracelet having a generally rectangular imprintable portion, an elongated strap portion at one end of the imprintable portion having a plurality of apertures extending generally along a longitudinal midline of the elongated strap portion, a stubby strap portion at an opposite end of the imprintable portion having a plurality of apertures extending generally along a longitudinal midline of the stubby strap portion, a transparent pocket containing a card, a machine readable radio frequency identification chip embedded in the card, and an antenna operatively connected to the chip; the imprintable portion being of a width equal to the width of the tape and the elongated and stubby strap portions each having a width less than that of the tape; the elongated strap portion having a longitudinal edge defined by one of the side edges of the tape and having an opposite longitudinal edge defined by one of the lines of weakness; and the stubby strap portion having a longitudinal edge defined by an opposite side edge of the tape relative to the elongated strap portion and having an opposite longitudinal edge defined by another one of the lines of weakness; wherein the imprintable and elongated strap portions share a common edge of the tape, the imprintable and stubby strap portions share an opposite common edge of the tape, the elongated and stubby strap portions being different lengths and as between adjacent bracelets, separated by the line of weakness, the bracelets aligned such that a portion of the elongated strap portion of at least one bracelet is adjacent and parallel to the stubby strap portion of an adjacent bracelet, and the elongated strap portion of each bracelet including means for operatively connecting the elongated and stubby strap portions.

26. A flexible, substantially non-stretchable, imprintable tape having parallel side edges; the tape having lines of weakness constituting tear lines defining in outline a longitudinal series of identification bracelets; each bracelet having a generally rectangular imprintable portion, an elongated strap portion at one end of the imprintable portion, and a stubby strap portion at an opposite end of the imprintable portion; the imprintable portion being of a width equal to the width of the tape and the elongated and stubby portions each having a width less than that of the tape; the elongated strap portion having a longitudinal edge defined by one of the side edges of the tape and having an opposite longitudinal edge defined by one of the lines of weakness and, the stubby strap portion having a longitudinal edge defined by an opposite side edge of the tape relative to the elongated strap portion and having an opposite longitudinal edge defined by another one of the lines of weakness; wherein the stubby strap portion of each bracelet includes a plurality of longitudinally extending apertures; wherein the elongated strap portion of each bracelet includes a plurality of longitudinally extending apertures; and a fastener having a male member and a female receptacle for connecting the apertures of the stubby strap to the apertures of the elongated strap portion.

27. The tape of claim 26, wherein the imprintable and elongated strap portions share a common edge of the tape.

28. The tape of claim 27, wherein the imprintable and stubby strap portions share an opposite common edge of the tape.

29. The tape of claim 26, wherein the bracelets are aligned such that a portion of the elongated strap portion of at least one bracelet is adjacent and parallel to the stubby strap portion of an adjacent bracelet.

30. The tape of claim 29, wherein the elongated and stubby strap portions of adjacent bracelets are separated by one of the lines of weakness.

31. The tape of claim 30, wherein the lines of weakness extend generally along a longitudinal midline of the tape and extend to the side edges of the tape at extremities of the lines of weakness.

32. The tape of claim 26, wherein the tape is rolled into a coil.

33. The tape of claim 26, wherein the lines of weakness are die-cuts extending partially through the tape.

34. The tape of claim 26, including a machine readable radio frequency identification chip associated with each bracelet.

35. The tape of claim 34, including an antenna operatively connected to each chip.

36. The tape of claim 26, including a transparent pocket containing a card associated with each bracelet.

37. The tape of claim 36, including a machine readable radio frequency identification chip and antenna embedded in each card.

* * * * *